US012377305B2

(12) United States Patent
Duplain

(10) Patent No.: US 12,377,305 B2
(45) Date of Patent: Aug. 5, 2025

(54) HINGEDLY PLATED LOCKING COLLAR FOR RETROFITTING A BARRED WEIGHT

(71) Applicant: DB MODS INC, Lake Worth, FL (US)

(72) Inventor: David Duplain, Lake Worth, FL (US)

( * ) Notice: Subject to any disclaimer, the term of this patent is extended or adjusted under 35 U.S.C. 154(b) by 116 days.

(21) Appl. No.: 18/483,490

(22) Filed: Oct. 9, 2023

(65) Prior Publication Data

US 2024/0033557 A1 Feb. 1, 2024

Related U.S. Application Data

(63) Continuation-in-part of application No. 17/718,178, filed on Apr. 11, 2022, now Pat. No. 11,878,200.

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC . A63B 21/06; A63B 21/0601; A63B 21/0609; A63B 21/065; A63B 21/072; A63B 21/0726; A63B 21/0728; A63B 21/075
See application file for complete search history.

(56) References Cited

U.S. PATENT DOCUMENTS 4,971,318 A * 11/1990 Tracy ..... A63B 21/0728 482/107
7,128,667 B2 * 10/2006 Nolan ..... A63B 21/06 473/422
8,900,104 B2 * 12/2014 Shozda ..... A63B 21/0728 482/106
10,625,136 B2 * 4/2020 Sites ..... A63B 21/0607
11,247,093 B2 * 2/2022 Chiang ..... A63B 21/075
11,324,986 B2 * 5/2022 Kehlenbach ..... A63B 21/08
11,666,793 B2 * 6/2023 Rothschild ..... A63B 21/0607 482/93
2005/0075221 A1 * 4/2005 Fond ..... A63B 21/0728 482/93
2009/0205106 A1 * 8/2009 Sohn ..... A63B 71/14 607/114
2013/0316880 A1 * 11/2013 Bosse ..... A63B 21/0728 482/107
2017/0304671 A1 * 10/2017 Hill ..... A63B 21/0726
2017/0361148 A1 * 12/2017 Black ..... A63B 21/0604
2020/0094100 A1 * 3/2020 Garcia Castillo .. A63B 21/0601

* cited by examiner

*Primary Examiner* — Joshua Lee

(57) ABSTRACT

A barred weight collar of hinged plates is provided to incrementally increase the weight characteristics of a bar weight. The collar includes a ring assembly of multiple, different plates formed from solid metal such as steel, which are hingedly coupled to one another and a frictional insert with an exterior shape matching an interior shape of the collar. A distal end of one of the plates is then coupled to a proximal end of an adjacent one of the plates with a latch. In this way, when the distal end of the one of the plates is coupled to the proximal end of the adjacent one of the plates with the latch, the different plates of the ring assembly form the collar which in turn collars a circumferential surface of one of two different weighted circumferential structures positioned oppositely along a bar of the bar weight, thereby incrementally increasing the weight characteristic of the bar weight.

12 Claims, 4 Drawing Sheets

HINGEDLY PLATED LOCKING COLLAR FOR RETROFITTING A BARRED WEIGHT

CROSS-REFERENCE TO RELATED APPLICATIONS

This application is a Continuation-in-Part under 35 U.S.C. § 120 of U.S. patent application Ser. No. 17/718,178, filed Apr. 11, 2022, the entirety of which is incorporated herein by reference.

BACKGROUND OF THE INVENTION

Field of the Invention

The present invention relates to the field of training equipment and more particularly to a barred weight accessory.

Description of the Related Art

Physical fitness includes the combined concepts of cardiovascular exercise and strength training. As to the latter, strength training primarily requires the use of specialized equipment by the individual so as to target the strengthening of specific groups of muscles. The most common tool, of course, is the barred weight in which weights are positioned at opposite ends of a bar. And, the most common construct of the barred weight is the combination of bar and weighted circumferential structures, such as circular discs or hexagonal discs. There are essentially two types of traditional bar weights combining a bar with weighted circumferential structures.

In the first instance, each weighted circumferential structure of correspondingly equal weight is permanently affixed to opposing ends of the bar so that the total weight represented by the bar weight is fixed and cannot be changed. The foregoing is most commonly found in the form of a dumbbell in which the bar is of limited length and designed to be held by a single hand. In the second instance, each weighted circumferential structure is only temporarily affixed to the opposing ends of the bar so that the total weight of the bar weight can be adjusted by either replacing the weighted circumferential structures affixed to the bar with differently weighted circumferential structures, or by adding or removing weighted circumferential structures from the bar.

In the former instance, where each bar weight is of fixed weight, in order to provide a variety of differently weighted bar weights, the user must store a multiplicity of different bar weights—typically on a rack of dumbbells, quite large in footprint. In the latter instance, where each bar weight can vary in weight according to the addition or removal of differently weighted circumferential structures, in order to provide a variety of different weighted bar weights, a multiplicity of different weighted circumferential structures, must be stored, typically on a spike of stacked weighted circumferential structures.

In either circumstance, as can be seen, a storage facility must be provided, for example a rack of the dumbbells, or a stack of the weighted circumferential structures. Yet, in a space limited setting, either circumstance is not preferred. Additionally, costs vary directly with increasingly heavier dumbbell sizes. For these reasons smaller gyms will often limit their dumbbell size range to one hundred pounds or less due to high cost and lack of space. This can result in a loss of sales because individuals who can utilize heavier sizes must travel to larger gyms with higher cost memberships.

BRIEF SUMMARY OF THE INVENTION

Embodiments of the present invention address deficiencies of the art in respect to the variable weighting of a bar weight and provide a novel and non-obvious adaptive weight belt retrofitting a bar weight. In an embodiment of the invention, a collar of hinged plates is provided. The collar includes a ring assembly of multiple, different plates formed from solid metal such as steel, which are hingedly coupled to one another, for instance with a hinge pin. A distal end of one of the plates is then coupled to a proximal end of an adjacent one of the plates with a latch such as a draw latch. A frictional insert is also provided with an exterior surface shape that matches a shape of an interior surface of the collar. In this way, when the distal end of the one of the plates is coupled to the proximal end of the adjacent one of the plates with the latch, the different plates of the ring assembly form the collar which by way of the frictional insert collars a circumferential surface of one of two different weighted circumferential structures positioned oppositely along a bar of the bar weight, thereby incrementally increasing the weight characteristic of the bar weight.

Aspect of the embodiment include the following options which may be present alone or in different combinations with one another:

- The collar has a circular shape and each of the plates includes a circular segment with a central angle matching a central angle of the circumferential surface.
- An interior portion of the collar has a polygonal shape matching a polygonal shape of the circumferential surface, and each of the plates includes a polygonal segment of at least three faces with each distal one of the faces having an identical angle of intersection to an adjacent one of the faces as each other distal one of the faces.
- An interior portion of the collar has a circular shape, such that the collar further includes a frictional insert such as a rubber insert with an exterior circular shape and an interior polygonal shape.
- An interior portion of the collar has a polygonal shape, such that the collar further includes a frictional insert such as a rubber insert with an exterior polygonal shape and an interior circular shape.
- The frictional insert is a set of frictional insert segments each coupled to an interior portion of a corresponding one of the plates with a spring which biases the insert away from the interior portion of the corresponding one of the plates.
- At least one of the plates has a floor support positioned at an exterior surface of the plate.

In consequence of the foregoing, it will be apparent to one of skill in the art that an existing set of barred weights can be expanded in weight, incrementally, without requiring the costly purchase of additional plates or dumbbells. Further, in consequence of the foregoing, it will be apparent to one of skill in the art that an existing set of barred weights can be expanded in weight, incrementally, without requiring the space inefficient arrangement of additional storage racks to support newly purchased plates or dumbbells. Indeed, whereas oftentimes gym owners purchase a set of dumbbells across a range of weights with a corresponding rack, incrementally increasing the heaviest of those dumbbells requires a completely new storage mechanism since the rack provided with the original set of dumbbells will have been filled with the initial set of weights. The hingedly plated locking collar described herein avoids both the excess cost of a completely new set of dumbbells, and also the necessity for additional storage rack expense and allocated space.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for a collar of hinged plates adapted to provide an adaptive weight belt retrofitting a bar weight. In accordance with an embodiment of the invention, the collar includes several hinged plates, each formed of solid metal such as steel or cast iron. The hinged plates are hinged to one another with a hinge pin, for example, at respective distal and proximal ends of the hinged plates with one of the plates having a hinge connection to an adjacent plate at a proximal end and a portion of a latch at a distal end, and another of the plates having a hinge connection to an adjacent plate at a distal end and a complimentary portion of the latch at the proximal end. In this way, the latch secures the two plates together forming a collar of hinged plates. In operation, the latch secures the two plates together forming the collar and friction fitting the collar to an exterior surface of a weight portion of a barred weight so as to incrementally increase the weight of the barred weight according to the cumulative weight of the plates of the collar while ensuring the collar does not slip from the weight portion of the barred weight.

Figure 1:
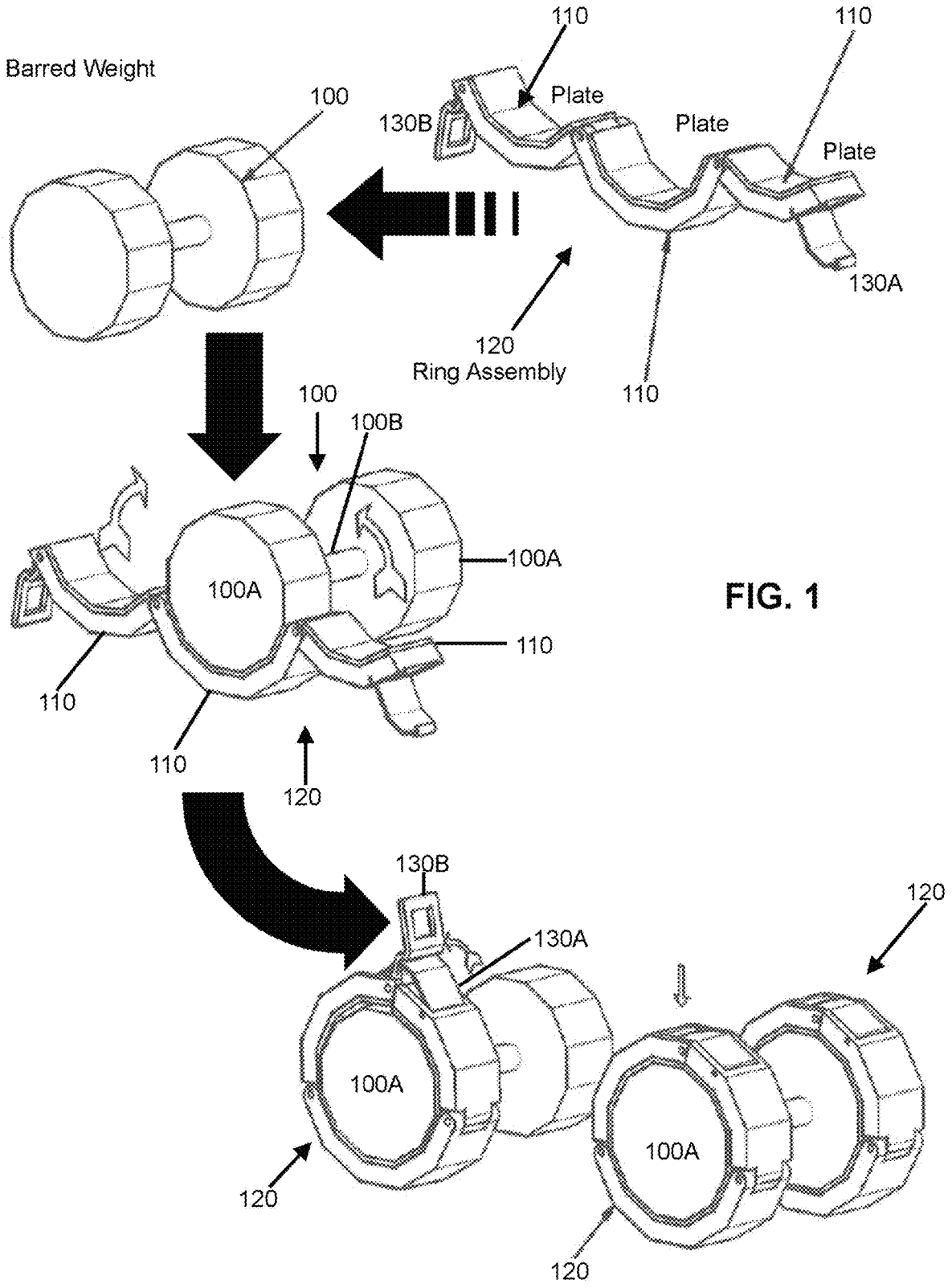
FIG. 1 is pictorial illustration of the incremental increasing of a weight characteristic of a bar weight with a collar of hinged plates.

In further illustration, FIG. 1 is pictorial illustration of the incremental increasing of a weight characteristic of a bar weight with a collar of hinged plates. As shown in FIG. 1, a ring assembly 120 of different plates 110, each of solid metal, are hinged to one another in sequence. One of the plates 110 at a distal end includes a keeper 130A and another of the plates 110 at a proximal end includes a hook 130B, the keeper 130A and the hook 130B forming a latch. In this way, when the keeper 130A engages the hook 130B around an exterior surface of the weight portion 100A of a barred weight 100 of two weight portions 100A coupled to one another by a bar 100B, the resulting ring assembly 120 forms a collar of hinged plates secured to the exterior surface of the weight portion 100A. The collar of hinged plates augments the weight of the weight portion 120A by the cumulative weight of the plates 110 of the ring assembly 120.

Figure 2:
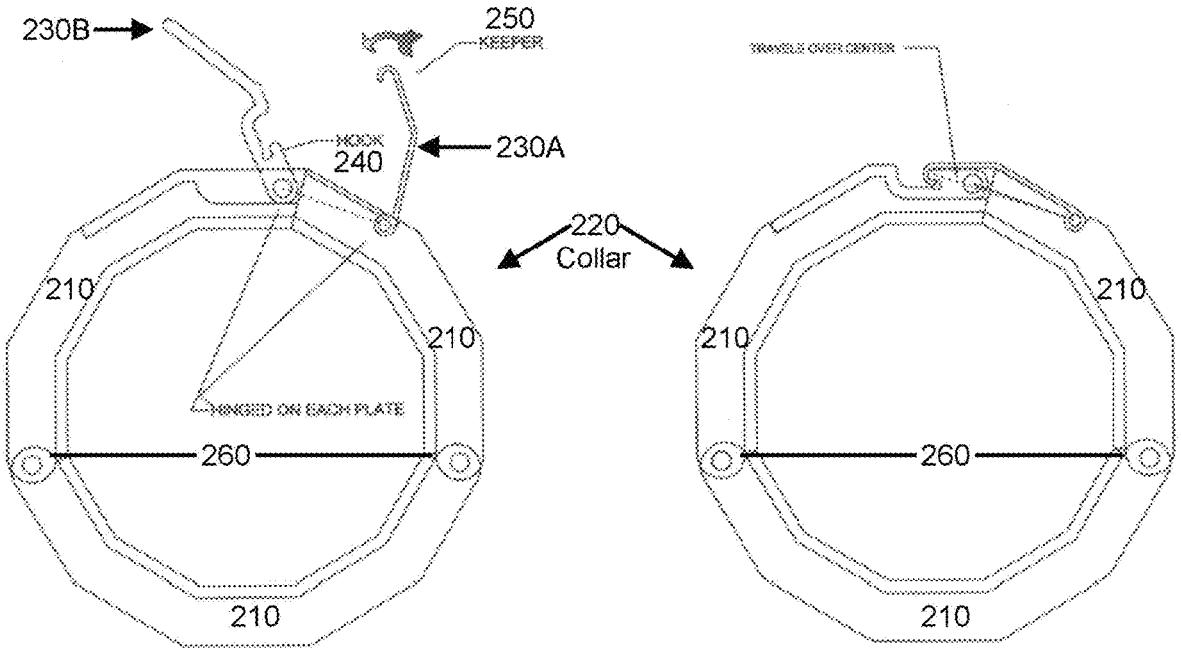
FIG. 2 is a side view of the collar of hinged plates of FIG. 1 secured through the operation of a latch.

In more particular illustration, FIG. 2 is a side view of the collar of hinged plates of FIG. 1 secured through the operation of a latch. As shown in FIG. 2, different plates 210 are hinged to one another in sequence with a common hinge pin 260. The plates 210 in the example shown in FIG. 2, when formed into the collar 220, have an interior portion of a polygonal shape matching a polygonal shape of a circumferential surface of the weight portion of a barred weight. To that end, each of the plates 210 includes a polygonal segment of at least three faces with each distal one of the faces has an identical angle of intersection to an adjacent one of the faces as each other distal one of the faces. One of the plates 210 at one end of the sequence of plates 210 has a latching portion 230A with a keeper 250 adapted to mate with a hook 240 of a complementary latching portion 230B of another of the plates 210 positioned at an opposite end of the sequence of plates 210 so as to form the collar 220 when the keeper 250 engages the hook 240 and is carried forth to a maximum travel distance drawing the hook 240 and the keeper 250 past the center of 230B hinge pin allowing the keeper 250 to be secured.

In an alternative aspect of the embodiment, the collar 220 can have a circular shape with each of the plates including, not a multifaced polygonal profile, but a circular profile with a circular segment having a central angle matching a central angle of the circumferential surface of the weight of the barred weight to which the collar 220 is to be affixed. In this regard, FIG. 3 is a perspective view of an aspect of a collar of hinged plates similar to that of FIG. 1 in which each of the plates of collar 320 has a circular profile with a circular segment having a central angle matching a central angle of the circumferential surface of the weight portion 300A of the barred weight to which the collar is to be affixed.

Figure 3:
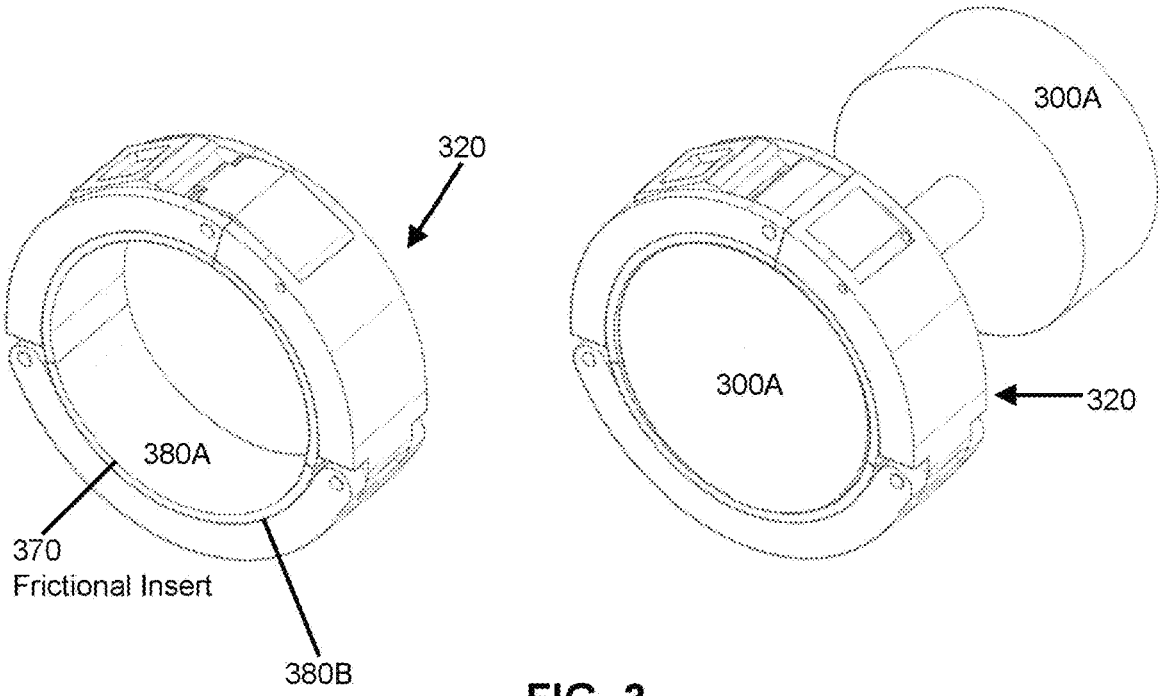
FIG. 3 is a perspective view of an aspect of the collar of hinged plates of FIG. 1, including a frictional insert having an exterior circular shape and an interior circular shape.

Notably, as shown in FIG. 3, the collar can support a frictional insert 370 fixed to the interior surface of the plates when secured into the collar 320. The frictional insert 370 can include different profiles adapted to match the profile of an exterior surface of the weight portion 300A of a barred weight. For instance, as shown in FIG. 3, the frictional insert 370 has an exterior circular shape 380B matching the interior profile of the collar 320, and an interior circular shape 380A matching the exterior profile of the weight portion 300A of the barred weight. The shape of the frictional insert 370, though can vary in other aspects of the embodiment.

Figure 4:
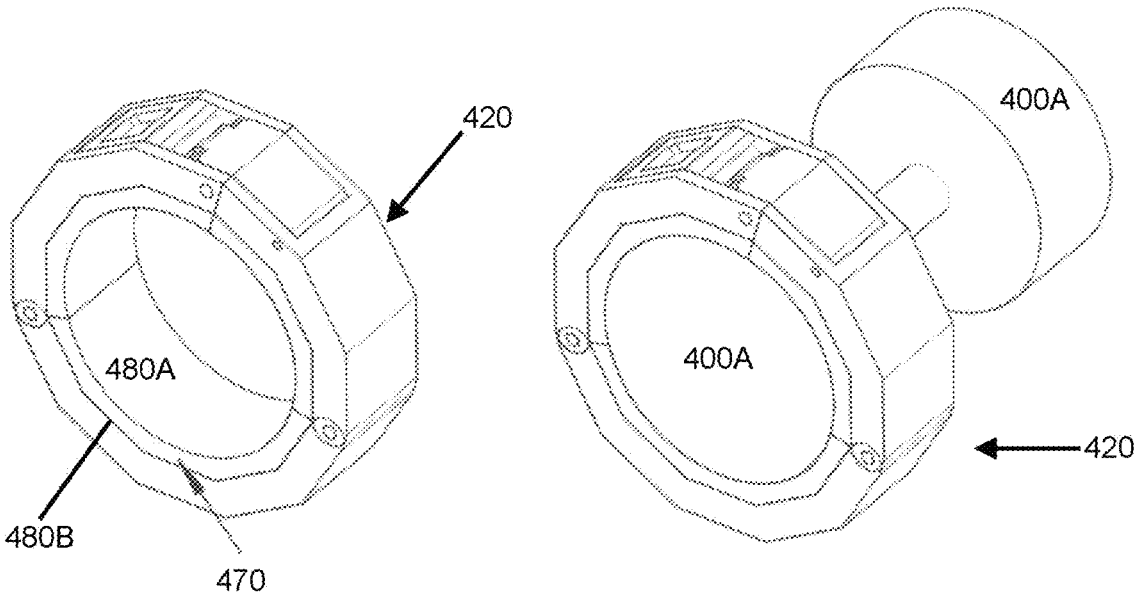
FIG. 4 is a perspective view of an aspect of the collar of hinged plates of FIG. 1, including a frictional insert having an exterior polygonal shape and an interior circular shape.
Figure 5:
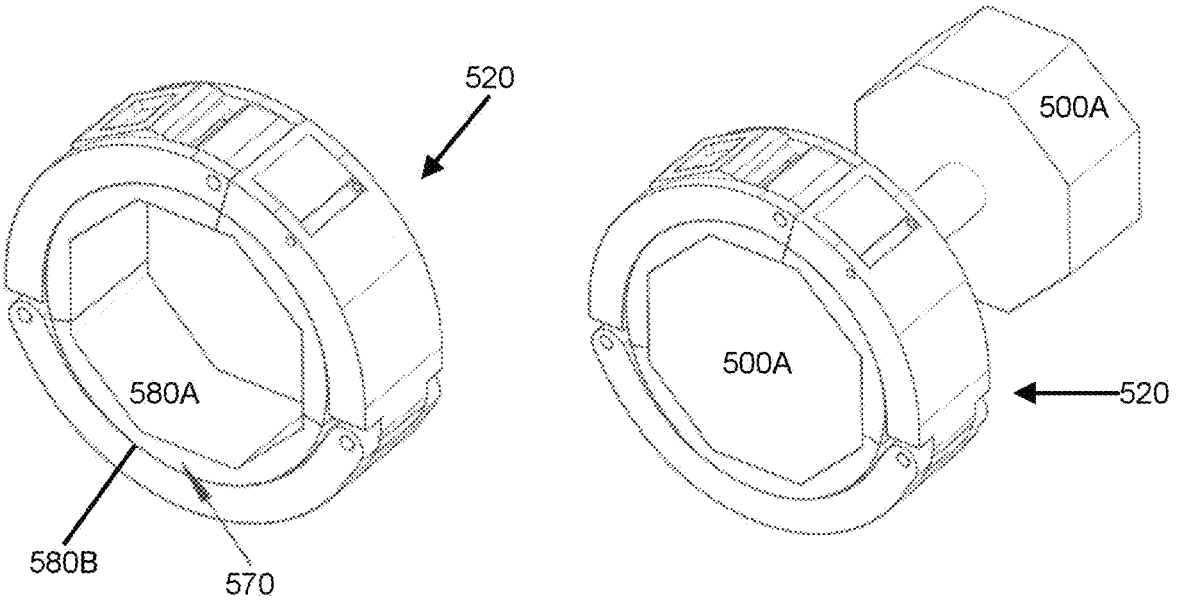
FIG. 5 is a perspective view of an aspect of the collar of hinged plates of FIG. 1, including a frictional insert having an exterior circular shape and an interior polygonal shape.

To that end FIG. 4 is a perspective view of an aspect of the collar of hinged plates of FIG. 1, including a frictional insert having an exterior polygonal shape and an interior circular shape. As shown in FIG. 4, a frictional insert 470 has an exterior polygonal shape 480B matching the shape of the interior portion of the collar 420, and an interior circular shape 480A matching the exterior profile of the weight portion 400A of the barred weight. Conversely, as shown in FIG. 5, a frictional insert 570 has an exterior circular shape 580B matching the shape of the interior portion of the collar 520, and an interior polygonal shape 580A matching the exterior profile of the weight portion 500A of the barred weight.

Figure 6:
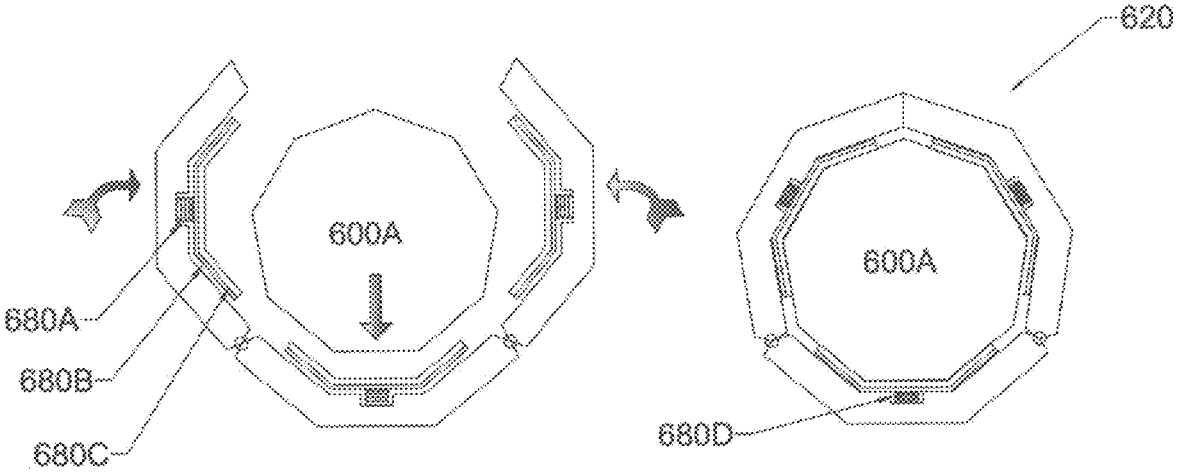
FIG. 6 is a side view of an aspect of the collar of hinged plates of FIG. 1, including separable spring biased fixed inserts for each of the hinged plates.

In an alternative aspect of the embodiment, each hinged plate in the collar can have a corresponding segment of a frictional insert. More particularly, FIG. 6 is a side view of an aspect of the collar of hinged plates of FIG. 1, including separable spring biased frictional inserts for each of the hinged plates. As shown in FIG. 6, each hinged plate of the collar 620 has a corresponding frictional insert segment 680B with a shape confirming to an interior portion of the corresponding frictional insert. The frictional insert segment 680B can be a steel or cast iron plate secured at an exterior surface to an interior surface of the corresponding hinged plate by a spring 680A, 680D (spring 680A in a compressed state and spring 680D in an extended state) biasing the plate 680B outwardly away from the interior surface of the corresponding hinged plate. A frictional pad 680C such as a rubber pad, polyethylene pad, fabric pad or other such fiction bearing material, is secured to an interior portion of the plate 680B. In this way, when the collar 620 envelops the exterior surface of the weight portion 600A of the barred weight, each frictional insert segment 680B through the frictional pad 680C separately engages a counterpart exterior surface of the weight portion 600A of the barred weight.

Figure 7:
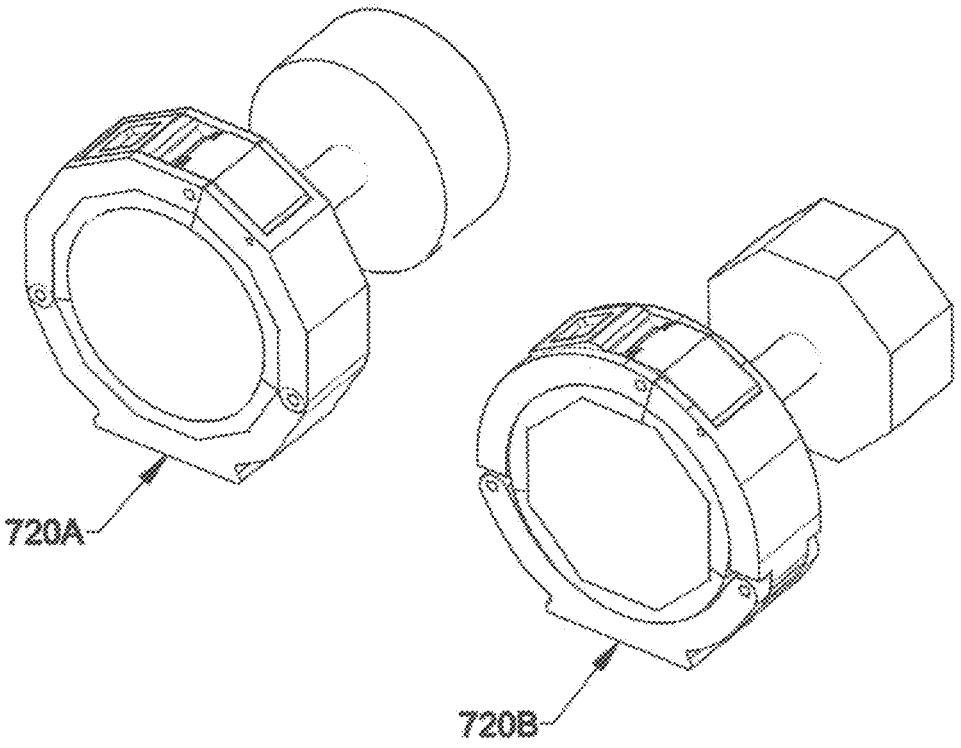
FIG. 7 is a perspective view of an aspect of the collar of hinged plates of FIG. 1 with at least one of the hinged plates including a floor support.

Finally, in even yet another aspect of the embodiment, one of the hinged plates can include a floor support that includes, by way of non-limiting example, an integrated trapezoidal foot 720A, 720B extending from a surface of the one of the hinged plates. As shown in FIG. 7, the floor support 720A, 720B be a unitary part of one of the hinged plates providing a flat base with opposing feet to stabilize the collar when the collar engages the exterior surface of the barred weight and rests on a flat surface.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "include", "includes", and/or "including," when used in this specification, specify the presence of stated features, elements, and/or components, but do not preclude the presence or addition of one or more other features, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

I claim:

1. A collar of hinged plates for incrementally increasing a weight characteristic of a bar weight, the collar comprising:

a ring assembly of multiplicity of different plates, the plates being hingedly coupled to one another and a distal end of one of the plates being coupled to a proximal end of an adjacent one of the plates with a latch, the different plates of the ring assembly when coupled to each other forming the collar;

each of the plates being formed from solid metal; and, a frictional insert with an exterior shape matching an interior shape of the collar;

whereby the collar collars a circumferential surface of one of two different weighted circumferential structures positioned oppositely along a bar of the bar weight, thereby incrementally increasing the weight characteristic of the bar weight.

2. The collar of claim 1, wherein the collar has a circular shape and each of the plates comprises a circular segment with a central angle matching a central angle of the circumferential surface.

3. The collar of claim 1, wherein an interior portion of the collar has a polygonal shape matching a polygonal shape of the circumferential surface, and each of the plates comprises a polygonal segment of at least three faces with each distal one of the faces having an identical angle of intersection to an adjacent one of the faces as each other distal one of the faces.

4. The collar of claim 1, wherein an interior portion of the collar has a circular shape, and the frictional insert has an exterior circular shape and an interior polygonal shape.

5. The collar of claim 1, wherein an interior portion of the collar has a polygonal shape, and the frictional insert has an exterior polygonal shape and an interior circular shape.

6. The collar of claim 1, wherein the frictional insert is a rubber insert.

7. The collar of claim 1, wherein the latch is a draw latch.

8. The collar of claim 1, wherein the hinged couplings each is a hinge pin.

9. The collar of claim 1, wherein the solid metal is steel.

10. The collar of claim 1, wherein the solid metal is cast iron.

11. The collar of claim 1, wherein the frictional insert comprises a multiplicity of frictional insert segments, each corresponding to a different one of the plates, each of the segments being secured to an interior portion of a corresponding one of the different one of the plates with a spring.

12. The collar of claim 1, wherein one of the plates comprises a trapezoidal foot extending from an exterior surface of the one of the plates.

* * * * *